US009173501B1

(12) United States Patent
Garner

(10) Patent No.: US 9,173,501 B1
(45) Date of Patent: Nov. 3, 2015

(54) HAND POSITIONAL TRAVEL PILLOW

(71) Applicant: Ricky George Garner, Dubuque, IA (US)

(72) Inventor: Ricky George Garner, Dubuque, IA (US)

( * ) Notice: Subject to any disclaimer, the term of this patent is extended or adjusted under 35 U.S.C. 154(b) by 12 days.

(21) Appl. No.: 14/066,538

(22) Filed: Oct. 29, 2013

(51) Int. Cl.
*A47C 16/00* (2006.01)
*A47G 9/10* (2006.01)

(52) U.S. Cl.
CPC . *A47C 16/00* (2013.01); *A47G 9/10* (2013.01); *A47G 9/1063* (2013.01); *A47G 9/1009* (2013.01); *A47G 9/1072* (2013.01); *A47G 2009/1018* (2013.01)

(58) Field of Classification Search
CPC ..... A47G 9/10–9/109
USPC ..... 5/636
See application file for complete search history.

(56) References Cited

U.S. PATENT DOCUMENTS

D314,116 S 1/1991 Reed
5,975,638 A 11/1999 Schreiner
6,010,192 A 1/2000 King
6,122,784 A 9/2000 Hurwitz
6,135,560 A 10/2000 Fagg
6,526,612 B1 * 3/2003 Zarrella ..... 5/636
6,942,297 B2 9/2005 Johnson
6,957,462 B1 10/2005 Wilcox
8,458,834 B1 6/2013 Brown
8,495,775 B2 7/2013 Fair et al.
2013/0117939 A1 * 5/2013 Moss ..... 5/644

* cited by examiner

*Primary Examiner* — Peter M Cuomo
*Assistant Examiner* — Brittany Wilson
(74) *Attorney, Agent, or Firm* — Williams Intellectual Property; Benjamin F. Williams

(57) ABSTRACT

A hand positional travel pillow that includes a medial protuberance disposed upon a first side of a pillow member, said medial protuberance disposed to accommodate a user's thumb and thenar when each of a respective first soft surface and a second soft surface are contacted to either of a user's hands, whereby a strap member, disposed to secure the pillow member to the user's respective hand, is reversible by transition over the medial protuberance and thereby positional tensioned across each of the first and alternately the second soft surfaces, as desired, for use with the pillow member engaged against each side of a user's head as comfort dictates.

6 Claims, 4 Drawing Sheets

HAND POSITIONAL TRAVEL PILLOW

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of travel pillows are known in the prior art. However, what is needed is a hand positional travel pillow that includes a medial protuberance disposed upon a first side of a pillow member, said medial protuberance disposed to accommodate a user's thumb and thenar when each of a respective first soft surface and a second soft surface are contacted to either of a user's hands, whereby a strap member, disposed to secure the pillow member to each of the user's respective hands, is reversible by transition over the medial protuberance and positional tensioned across each of the first and alternately the second soft surfaces, as desired, for use with the pillow member engaged against each side of a user's head.

FIELD OF THE INVENTION

The present invention relates to a hand positional travel pillow, and more particularly, to a hand positional travel pillow that includes a medial protuberance disposed upon a first side of a pillow member, said medial protuberance disposed to accommodate a user's thumb and thenar when each of a respective first soft surface and a second soft surface are contacted to either of a user's hands, whereby a strap member, disposed to secure the pillow member to the each of user's respective hands, is reversible by transition over the medial protuberance and positional thereby tensioned across each of the first and alternately the second soft surfaces, as desired, for use with the pillow member engaged against each side of a user's head, as comfort dictates.

SUMMARY OF THE INVENTION

The general purpose of the hand positional travel pillow, described subsequently in greater detail, is to provide a hand positional travel pillow which has many novel features that result in a hand positional travel pillow which is not anticipated, rendered obvious, suggested, or even implied by prior art, either alone or in combination thereof.

The present hand positional travel pillow has been devised to enable a portable pillow usable when traveling for comfort and support of a user's head by securing to each of a user's pair of hands, as desired for comfort, whereby positional engagement of each of a respective first soft surface and a second soft surface against said user's head is effective.

The present hand positional travel pillow, therefore, includes a pillow member. In the preferred embodiment herein disclosed, the pillow member comprises memory foam disposed within a silk outer layer, said pillow member thereby conformable to support and comfort a user's head and neck when using the hand positional travel pillow.

The pillow member is generally ovoid and includes a first soft surface and second soft surface disposed between a soft perimeter. A medial protuberance is disposed upon a first side of the pillow member, said medial protuberance disposed to accommodate the position of a user's thumb and thenar when the pillow member is positioned to contact a user's hand, as will be subsequently described.

The pillow member is devised, therefore, to position in a plane in parallel with a user's hand, whereby the soft perimeter extends beyond the extremities of the user's hand. The medial protuberance extends around a user's thumb and thenar whereby each of the first and second soft surfaces of the pillow member is positional engaged against a respective side of a user's head.

The pillow member is securable to a user's hand by means of a strap member disposed diagonally thereon, said strap member disposed to cross over the basal and alternately dorsal side of a user's hand, as dictated by the comfort of the user, whereby the pillow member is retained in contact with the user's hand.

The strap member includes a first end attached below the medial protuberance upon the soft perimeter, at the first side of the pillow member. The strap member also includes a second end attached upon the soft perimeter, at a second side of the pillow member. The strap member is reversible, and thereby positional to diagonally cross each of the first and second soft surfaces between the first and second sides of the pillow member without detachment of the first and second ends, whereby the hand positional travel pillow is securable to either of a user's hands, and thereby positional, as dictated by a user's comfort, against either side of the user's head for comfort and support when sleeping, or otherwise resting, in a seated position or during travel.

The strap member is moveable from each of the first and second soft surfaces to the other of said first and second soft surfaces by movement and transition over the medial protuberance. When moved over the medial protuberance, the strap member is slackened, the width of the pillow member lessening thereat, whereby the strap member is readily reversible and positional to cross the other of the respective first and second soft surfaces, as desired for comfort and positioning of the pillow member against a respective side of a user's head.

Thus has been broadly outlined the more important features of the present hand positional travel pillow so that the detailed description thereof that follows may be better understood and in order that the present contribution to the art may be better appreciated.

Objects of the present hand positional travel pillow, along with various novel features that characterize the invention are particularly pointed out in the claims forming a part of this disclosure. For better understanding of the hand positional travel pillow, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
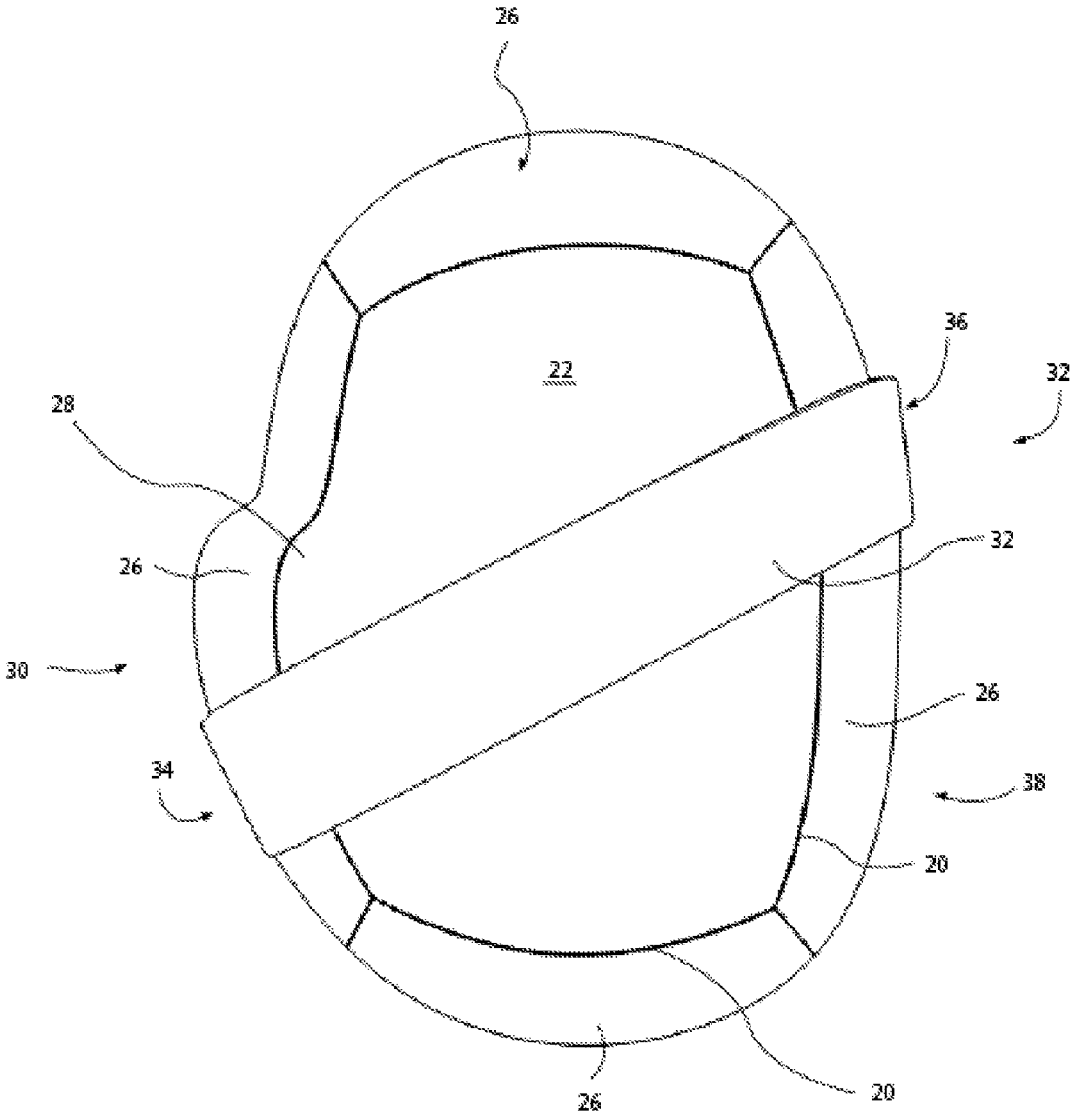
FIG. 1 is an isometric view of a first soft surface of a pillow member.
Figure 2:
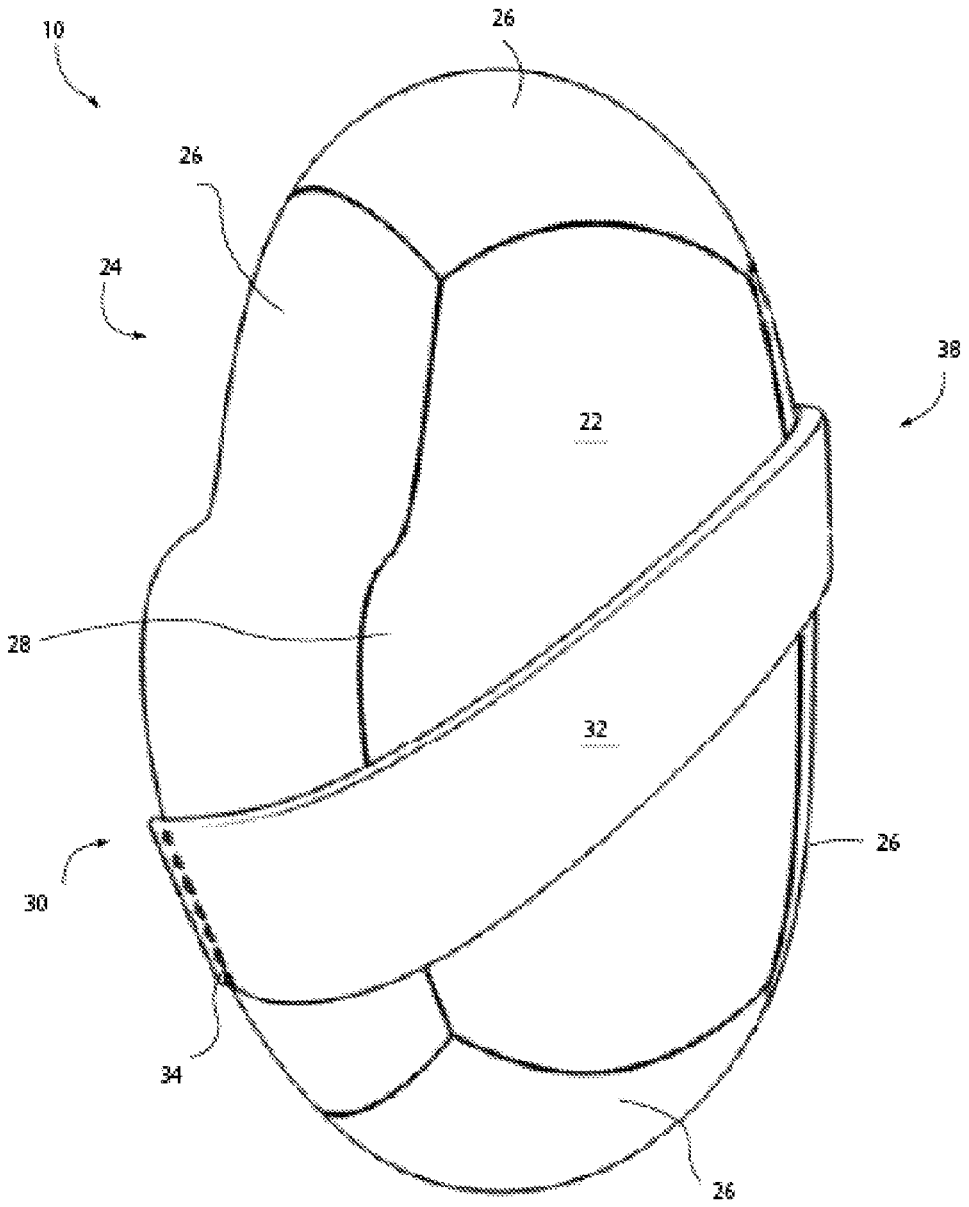
FIG. 2 is an isometric view from a first side of the pillow member.
Figure 3:
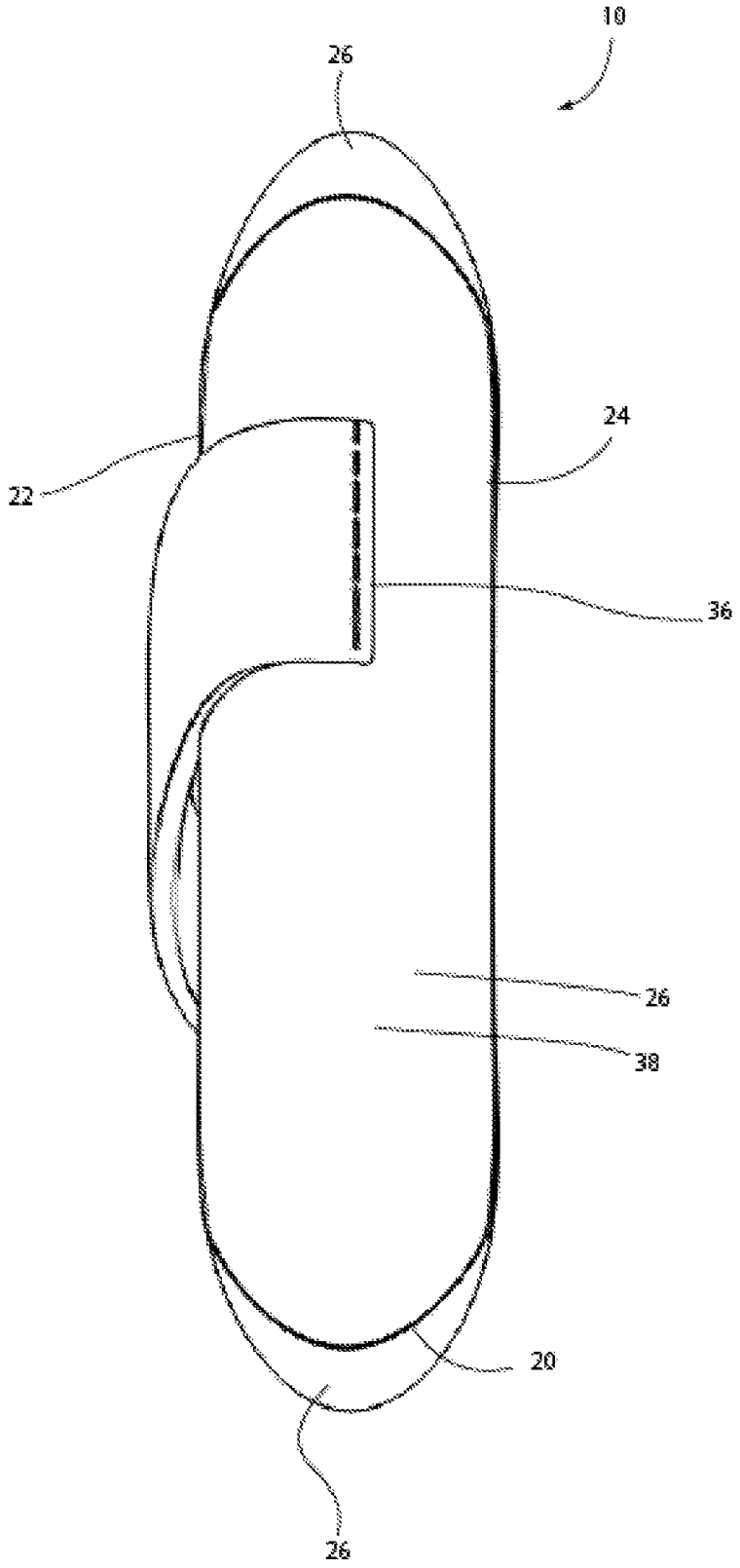
FIG. 3 is a side view of the pillow member
Figure 4:
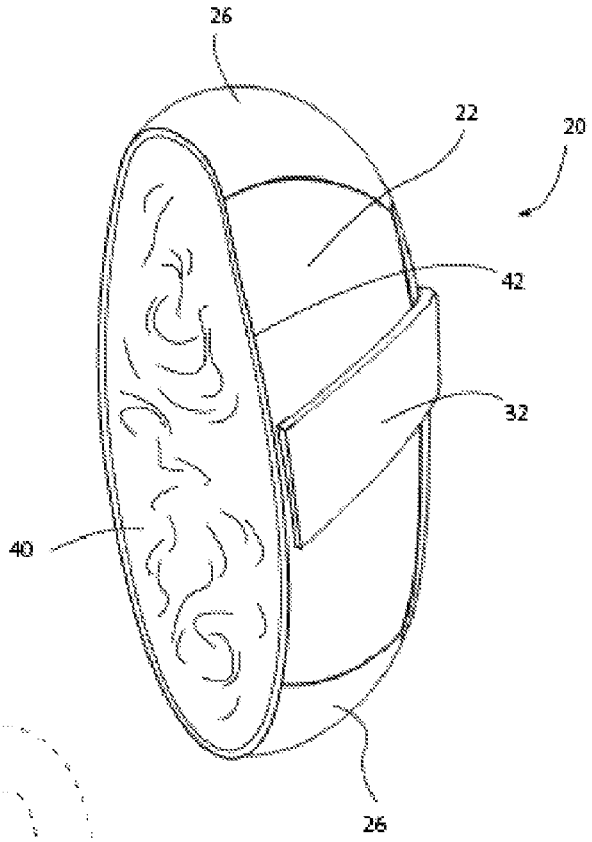
FIG. 4 is a cross section view of the pillow member.
Figure 5:
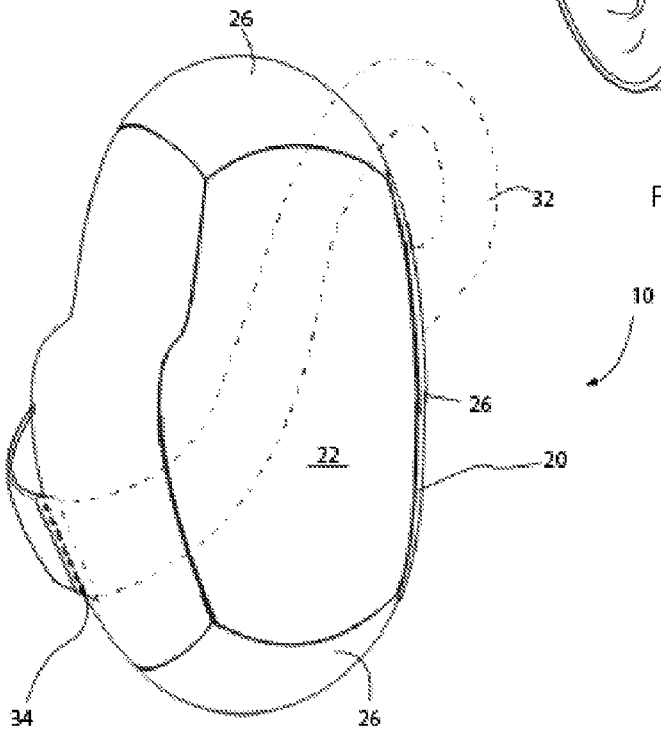
FIG. 5 is an isometric view illustrating transition of a strap member from a position overlying the first soft surface to a position overlying a second soft surface of the pillow member.

With reference now to the drawings, and in particular FIGS. 1 through 5 thereof, example of the instant hand positional travel pillow employing the principles and concepts of the present hand positional travel pillow and generally designated by the reference number 10 will be described.

Referring to FIGS. 1 through 5 a preferred embodiment of the present hand positional travel pillow 10 is illustrated.

The present hand positional travel pillow 10 has been devised to enable comfort when traveling or seated in an upright position, such as when flying or traveling in an automobile, and secures readily to a user's hand for positional engagement against the user's head. The present hand positional travel pillow 10 is readily portable for use when traveling.

The hand positional travel pillow 10, therefore, includes a generally ovoid pillow member 20 having a first soft surface 22 and a second soft surface 24 disposed between a soft perimeter 26. The pillow member 20 includes a medial protuberance 28 disposed upon a first side 30 of the pillow member 20, said medial protuberance 28 disposed to accommodate a thumb and thenar of a user.

The pillow member 20, therefore, is conformed to occupy a plane disposed in parallel with a hand of a user, and extends the soft perimeter 26 beyond the extremities of said user's hand—including accommodating the extended thumb and thenar of a user—whereby the pillow member 20 is supportable upon a user's hand and positional thereat for contact with a user's head, as desired, when sleeping in an upright position.

To secure the pillow member 20 to a user's hand, a strap member 32 is disposed diagonally across the pillow member 20. The strap member 32 includes a first end 34, attached at a position upon the soft perimeter 26 disposed under the medial protuberance 28 upon the first side 30 of the pillow member, and a second end 36 disposed attached at a position upon the soft perimeter 26 at a second side 38 of the pillow member 20.

The strap member 32 is positioned to cross over the dorsal or basal side of a user's hand, and support the pillow member 20 in position with the soft perimeter 26 extended beyond the extremities of a user's hand. The strap member 32 is reversible and positional to cross each of the first soft surface 22 and alternately the second soft surface 24 without detachment from the pillow member 20.

The strap member 32 is moveable from each of the corresponding first soft surface 22 and second soft surface 24 to the other of said respective surfaces 22, 24, by movement of the strap member 32 over the medial protuberance 28. Once the strap member 32 is moved over the medial protuberance 28, said strap member 28 is slackened for transition to one of the respective first and second soft surfaces 22, 24, as desired when repositioning the strap member 32 for use of the pillow member 20 with each respective one of a user's hands.

Each of a user's hands is therefore positional against each of the respective first and second soft surfaces 22, 24, as desired, for use of the pillow member 20 engaged against a respective side of the user's head, as preferred for comfort.

The pillow member 20 is therefore retainable upon each of said hands by contact with the strap member 32, whereby the each of the respective first and second soft surfaces 22, 24 is positional against the head of a user for comfort when seated or during travel.

In the preferred embodiment herein disclosed, the pillow member comprises memory foam 40 enveloped in a silk outer layer 42 for additional comfort and conformability to a user's head and neck when resting thereon.

What is claimed is:

1. A hand positional travel pillow comprising a generally ovoid pillow member including a first soft surface and a second soft surface, said pillow member having a medial protuberance disposed upon a first side, accommodative of a thumb and thenar of a user, and a strap member disposed diagonally across the second soft surface from a position disposed under the medial protuberance upon the first side to a position disposed at the second side, wherein a hand of the user is positional against the second soft surface and the pillow member is retainable upon said hand by contact with the strap member whereby the first soft surface is positional against the head of a user for comfort when seated or traveling.

2. The hand positional travel pillow of claim 1 wherein the strap member is positional to cross the first soft surface and alternately the second soft surface without detaching from the pillow member, whereby the pillow member is securable to each of a pair of hands of the user.

3. A hand positional travel pillow comprising a generally ovoid pillow member including a first soft surface and a second soft surface, said pillow member having a medial protuberance disposed upon a first side, accommodative of a thumb and thenar of a user, and a strap member disposed diagonally across the pillow member from a position disposed under the medial protuberance upon the first side to a position disposed at the second side, said strap member reversible to cross each of the first soft surface and alternately the second soft surface without detachment from the pillow member, wherein each of a pair of hands of the user is positional against each of the respective first and second soft surfaces and the pillow member is retainable upon each of said hands by contact with the strap member, whereby each of the respective first and second soft surfaces is positional against the head of a user for comfort when seated or traveling.

4. The hand positional travel pillow of claim 3 wherein the pillow member is made of memory foam.

5. The hand positional travel pillow of claim 4 wherein the pillow member further comprises an outer layer, said outer layer rendered of silk.

6. A hand positional travel pillow shaped to occupy a plane positioned parallel with a hand of a user, said hand positional travel pillow disposed to extend beyond the extremities of said hand when positioned against said hand, said hand positional travel pillow comprising:

a generally ovoid pillow member having a first soft surface and a second soft surface, each of said first and second soft surfaces surrounded by a soft perimeter, said soft perimeter disposed across each of a first side and a second side of the pillow member;

a medial protuberance disposed upon the first side of the pillow member, said medial protuberance disposed to accommodate the thumb and thenar of a hand of a user positioned against the pillow member; and a strap member disposed diagonally across the pillow member, said strap member including a first end attached to the soft perimeter at a position underlying the medial protuberance, and a second end attached to the soft perimeter at the second side of the pillow member, said strap member positional to overlie each of the first soft surface and the second soft surface without detachment from the pillow member, as desired, for use with each of a pair of hands of the user;

wherein each of the pair of hands of the user is positional against each of the respective first and second soft surfaces, and the pillow member is retainable upon each of said hands by contact with the strap member, whereby each of the respective first and second soft surfaces is positional against the head of a user for comfort when seated or traveling.

* * * * *